US010947458B1

(12) United States Patent
Liu et al.

(10) Patent No.: US 10,947,458 B1
(45) Date of Patent: Mar. 16, 2021

(54) UPGRADING OF RENEWABLE FEEDSTOCKS WITH SPENT EQUILIBRIUM CATALYST

(71) Applicant: CHEVRON U.S.A. INC., San Ramon, CA (US)

(72) Inventors: Tengfei Liu, Fairfield, CA (US); Mingting Xu, Walnut Creek, CA (US); Kandaswamy Jothimurugesan, Hercules, CA (US); Richard Grove, Spanish Fort, AL (US); Michael K. Maholland, Park City, UT (US); Michelle Young, Marvel, TX (US); Winnie Lieu, San Mateo, CA (US); Cameron McCord, Martinez, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/822,223

(22) Filed: Mar. 18, 2020

(51) Int. Cl.
*C10G 11/02* (2006.01)

(52) U.S. Cl.
CPC ..... *C10G 11/02* (2013.01); *C10G 2300/1014* (2013.01); *C10G 2300/1018* (2013.01); *C10G 2400/02* (2013.01); *C10G 2400/20* (2013.01)

(58) Field of Classification Search
None
See application file for complete search history.

(56) References Cited

U.S. PATENT DOCUMENTS 6,482,315 B1 * 11/2002 Roberie ..... C10G 11/05 208/208 R
7,288,685 B2 10/2007 Marker
7,540,952 B2 6/2009 Pinho et al.
8,207,385 B2 6/2012 O'Connor et al.
10,479,943 B1 11/2019 Liu et al.
2004/0069681 A1 * 4/2004 Peterson ..... B01J 8/1818 208/113
2012/0024748 A1 * 2/2012 Subramani ..... B01J 29/80 208/14
2014/0163285 A1 6/2014 Buchanan et al.
2015/0337207 A1 * 11/2015 Chen ..... C10G 51/026 585/240

OTHER PUBLICATIONS

P. Bielansky, A. Reichhold and C. Schonberger "Catalytic cracking of rapeseed oil to high octane gasoline and olefins" Chem. Eng. Process. 2010, 49, 873-880.
P. Bielansky, A. Weinert, C. Schonberger and A. Reichhold "Catalytic conversion of vegetable oils in a continuous FCC pilot plant" Fuel Proc. Technol. 2011, 92, 2305-2311.
M. Al-Sabawi, J. Chen and S. Ng "Fluid Catalytic Cracking of Biomass-Derived Oils and Their Blends with Petroleum Feedstocks: A Review" Energy Fuels 2012, 26, 5355-5372.

* cited by examiner

*Primary Examiner* — Tam M Nguyen

(57) ABSTRACT

A process is provided for upgrading a renewable feedstock. The process includes introducing the renewable feedstock into a fluid catalytic cracking (FCC) reactor unit operating under catalytic cracking conditions and comprising a circulating inventory of an equilibrium catalyst composition; removing a portion of the equilibrium catalyst inventory from the FCC reactor unit while replacing all the equilibrium catalyst removed from the unit with a spent catalyst to obtain a composite circulating catalyst within the FCC reactor unit; and contacting the composite circulating catalyst with the renewable feedstock in the FCC reactor unit under a steady state environment to provide a product stream comprising cracked products.

16 Claims, 7 Drawing Sheets

UPGRADING OF RENEWABLE FEEDSTOCKS WITH SPENT EQUILIBRIUM CATALYST

FIELD

This disclosure relates to the production of hydrocarbons from renewable resources.

BACKGROUND

Biofuels that can be produced from renewable domestic resources offer an alternative to petroleum-based fuels. In order to encourage the production and consumption of biofuels in the United States, regulatory agencies have taken steps to mandate and incentivize increased production of fuels from renewable sources. For example, California's Low Carbon Fuel Standard Program (LCFS) requires producers of petroleum-based fuels to reduce the carbon intensity of their products, beginning with a quarter of a percent in 2011, and culminating in a 20 percent total reduction in 2030. Petroleum importers, refiners, and wholesalers can either develop their own low carbon fuel products or buy LCFS credits from other companies that develop and sell low carbon alternative fuels.

Likewise, the United States Congress created the Renewable Fuel Standard (RFS) program to reduce greenhouse gas emissions and expand the nation's renewable fuels sector while reducing reliance on imported oil. This program was authorized under the Energy Policy Act of 2005, and the program was further expanded under the Energy Independence and Security Act of 2007. Being a national policy, the RFS program requires the replacement or reduction of a petroleum-based transportation fuel, heating oil, or jet fuel with a certain volume of renewable fuel. The RFS requires renewable fuel to be blended into transportation fuel in increasing amounts each year, escalating to 36 billion gallons by 2022. Each renewable fuel category in the RFS program must emit lower levels of greenhouse gases (GHGs) relative to the petroleum fuel it replaces. The four renewable fuel categories under the RFS program include biomass-based diesel, cellulosic biofuel, advanced biofuel, and total renewable fuel.

Current commercial production methods of biofuels include esterification of triglycerides, fats, and fatty acids, transesterification of fatty esters, fermentation of sugar, catalytic upgrading of sugars, and biogas- and biomass-to-liquids methods. These methods have been primarily focused on the production of ethanol and biodiesel and have not been very successful for producing large quantities of non-oxygenated renewable fuels. However, production of renewable hydrocarbons will help producers meet increasing environmental regulations and offer an attractive alternative for consumers that are interested in environmentally friendly fuel alternatives which are replacements for non-renewable hydrocarbon components. Thus, there is a need in the industry for commercially feasible methods for the production of fuels from renewable sources.

SUMMARY

In one aspect, there is provided a process for upgrading a renewable feedstock, the process comprising: (a) introducing the renewable feedstock into a fluid catalytic cracking (FCC) reactor unit operating under catalytic cracking conditions and comprising a circulating inventory of an equilibrium catalyst composition; (b) removing a portion of the equilibrium catalyst inventory from the FCC reactor unit while replacing all the equilibrium catalyst removed from the unit with a spent catalyst to obtain a composite circulating catalyst within the FCC reactor unit; and (c) contacting the composite circulating catalyst with the renewable feedstock in the FCC reactor unit under a steady state environment to provide a product stream comprising cracked products.

DETAILED DESCRIPTION

Definitions

Figure 1:
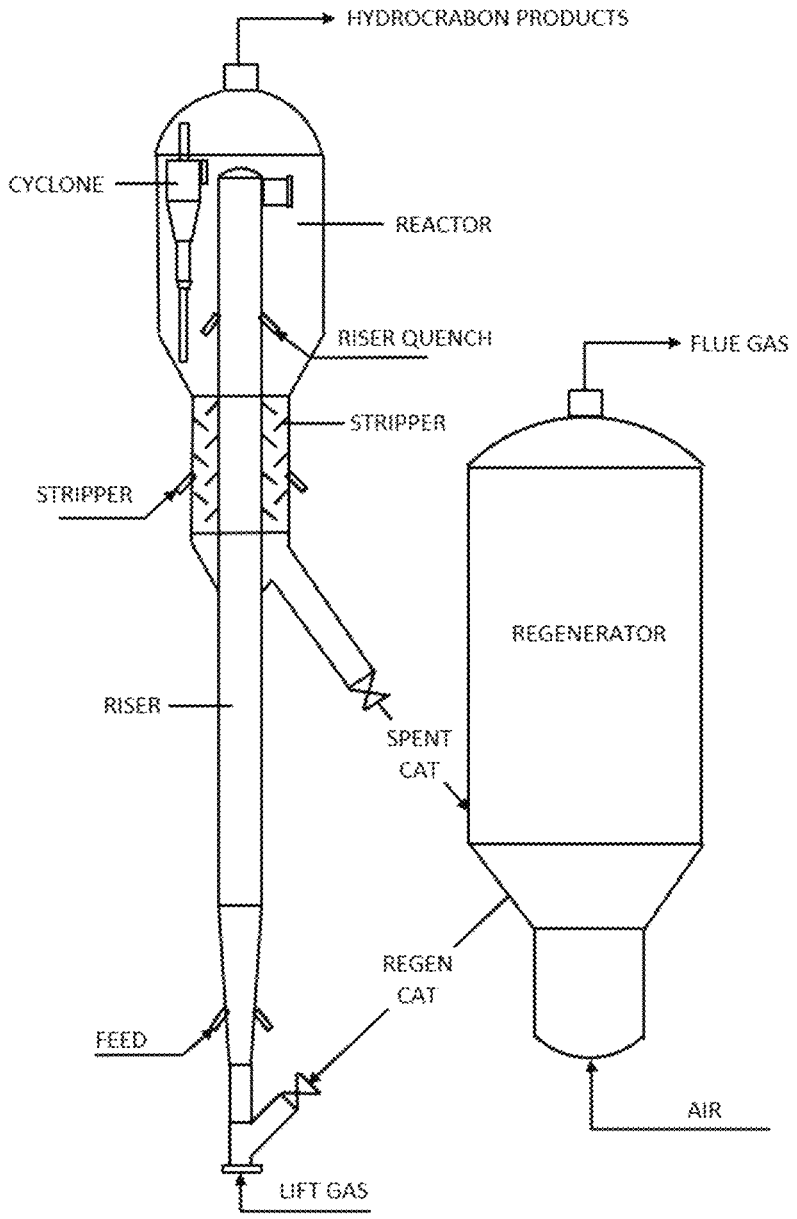
FIG. 1 depicts a schematic of an illustrative fluid catalytic cracking (FCC) system, according to one or more embodiments described.

The term "renewable feedstock" refers to a material originating from a renewable resource (e.g., plants) and non-geologically derived. The term "renewable" is also synonymous with the term "sustainable", "sustainably derived", or "from sustainable sources". The term "geologically derived" means originating from, for example, crude oil, natural gas, or coal. "Geologically derived" materials cannot be easily replenished or regrown (e.g., in contrast to plant- or algae-produced oils).

The term "equilibrium catalyst" or "Ecat" is used herein to indicate the inventory of circulating fluid cracking catalyst composition in an FCC unit operating under catalytic cracking conditions. For purpose of this disclosure, the terms "equilibrium catalyst", "spent catalyst" (catalyst taken from an FCC unit) and "regenerated catalyst" (catalyst leaving a regeneration unit) shall be deemed equivalent.

A "spent catalyst" denotes a catalyst that has less activity at the same reaction conditions (e.g., temperature, pressure, inlet flows) than the catalyst had when it was originally exposed to the process. This can be due to a number of reasons, several non-limiting examples of causes of catalyst deactivation are coking or carbonaceous material sorption or accumulation, steam or hydrothermal deactivation, metals (and ash) sorption or accumulation, attrition, morphological changes including changes in pore sizes, cation or anion substitution, and/or chemical or compositional changes.

A "regenerated catalyst" denotes a catalyst that had become spent, as defined above, and was then subjected to a process that increased its activity to a level greater than it had as a spent catalyst. This may involve, for example, reversing transformations or removing contaminants outlined above as possible causes of reduced activity. The regenerated catalyst typically has an activity that is equal or less than the fresh catalyst activity.

A "fresh catalyst" denotes a catalyst which has not previously been used in a catalytic process.

The term "steady state" is used herein to indicate operating conditions within a FCC reactor unit wherein there exists within the unit a constant amount of catalyst inventory having a constant catalyst activity at a constant rate of feed of a feedstock having a defined composition to obtain a constant conversion rate of products. "Catalyst activity" can be determined on a weight percent basis of conversion of a standard feedstock at standard FCC conditions by the catalyst microactivity test in accordance with ASTM D3907.

The term "upgrading" refers to a process wherein a feedstock is altered to have more desirable properties.

The term "biofuel" refers here to liquid fuels obtained from renewable feedstock (e.g., feedstock of biological origin).

Renewable Feedstock

The feedstock may originate from any renewable source such as from plants, animals, algae, and microbiological processes. Renewable feedstocks can be derived from a biological raw material component such as vegetable oils, animal fats, and algae oils. The common feature of these sources is that they are composed of glycerides and free fatty acids (FFAs). Both of these classes of compounds contain aliphatic carbon chains having from 8 to 24 carbon atoms. The aliphatic carbon chains in the glycerides or FFAs can be saturated or mono-, di- or poly-unsaturated.

The renewable feedstocks that can be used herein include any of those which comprise glycerides and FFAs. Most of the glycerides will be triglycerides, but monoglycerides and diglycerides may be present and processed as well.

With regard to triglyceride content, the renewable feedstock can contain at least 10 wt. % (e.g., at least 25 wt. %, at least 50 wt. %, at least 75 wt. %, or at least 90 wt. %) triglycerides. Additionally or alternatively, the renewable feedstock be composed entirely of triglycerides.

Representative examples of vegetable oils include castor oil, canola oil, coconut oil, corn oil, cottonseed oil, jatropha oil, linseed oil, mustard oil, olive oil, palm oil, palm kernel oil, peanut oil, rapeseed oil, safflower oil, sesame oil, soybean oil, and sunflower oil. Useful vegetable oils can also include processed vegetable oil materials such as the fatty acids and fatty acid ($C_1$ to $C_5$) alkyl esters derived from vegetable oils.

Representative examples of animal fats include beef fat (tallow), hog fat (lard), poultry fat, and fish oil. Useful animal fats can also include processed animal fat materials such as the fatty acids and fatty acid ($C_1$ to $C_5$) alkyl esters derived from animal fats.

The renewable feedstock can also contain impurities. These impurities can include gums (e.g., phospholipids), suspended solids, and metals (e.g., Na, K, Mg, Ca, Mn, Fe, Cu, Zn).

The renewable feedstock can be subjected to at least one purification treatment prior to catalytic cracking. In the purification treatment, the feedstock is fed to a purification unit, where the purification treatment is carried out. In the purification unit, at least one purification step is carried out. The purification step can be selected from filtration, degumming, bleaching, solvent extraction, hydrolysis, ion-exchange resin treatment, mild acid wash, evaporative treatment, and any combination thereof. The purification steps may be same or different. The purification unit comprises necessary equipment for carrying out the purification step or steps. The purification unit may comprise one or more pieces of the same of different purification equipment, and, when more than one pieces of equipment are used, they are suitably arranged in series.

In some aspects, the renewable feedstock comprises predominantly a renewable feedstock with no significant quantity of a hydrocarbon source or type other than the renewable feedstock. Thus, in one aspect, the feedstock introduced into a riser reactor zone comprises a material absence of a hydrocarbon source other than the renewable feedstock. The feedstock introduced into the riser reactor zone can comprise less than 10 vol. % (e.g., less than 5 vol. %, less than 1 vol. %, or 0 vol. %) of a hydrocarbon source other than the renewable feedstock.

It is normally preferred to carry out the catalytic cracking in a unit dedicated to renewable feed cracking (i.e., with a feed comprised entirely of renewable feedstock). In such cases, the product from the cracking unit is a renewable product produced in industrially relevant amounts by the process as described herein. By "industrially relevant amounts" is meant amounts that enter the consumer market rather than laboratory scale amounts. In one example, industrially relevant amounts are produced continuously at greater than 100 liters of renewable product per day for a time period of at least one month.

FCC Process

Fluid catalytic cracking is a conversion process in petroleum refineries wherein high-boiling, high-molecular weight hydrocarbon feedstocks are converted to more valuable gasoline, olefinic gases, and other products.

FIG. 1 depicts a schematic of an illustrative fluid catalytic cracking (FCC) unit, according to one or more embodiments. The FCC unit includes a riser reactor, a separator and a regenerator each thereof being operatively interconnected.

Somewhat briefly, the fluid catalytic cracking process in which the renewable feed will be cracked to lighter hydrocarbon products takes place by contact of the feed in a cyclic catalyst recirculation cracking process with a circulating fluidizable catalytic cracking catalyst inventory consisting of particles having a size ranging from about 20 to about 100 microns. The significant steps in the cyclic process are: (1) the feed is catalytically cracked in a catalytic cracking zone, normally a riser cracking zone, operating at catalytic cracking conditions by contacting feed with a source of hot, regenerated cracking catalyst to produce an effluent comprising cracked products and spent catalyst containing coke and strippable hydrocarbons; (2) the effluent is discharged and separated, normally in one or more cyclones, into a vapor phase rich in cracked product and a solids rich phase comprising the spent catalyst; (3) the vapor phase is removed as product and fractionated in the FCC main column and its associated side columns to form liquid cracking products including gasoline; and (4) the spent catalyst is stripped, usually with steam, to remove occluded hydrocarbons from the catalyst, after which the stripped catalyst is oxidatively regenerated to produce hot, regenerated catalyst which is then recycled to the cracking zone for cracking further quantities of feed.

Suitable cracking conditions can include a reaction temperature of 797° F. to 977° F. (425° C. to 525° C.) or 842° F. to 932° F. (450° C. to 500° C.) with a catalyst regeneration temperature of 600° C. to 800° C.; a hydrocarbon partial pressure of 100 to 400 kPa (e.g., 175 to 250 kPa); a catalyst-to-oil ratio of 2:1 to 20:1 (e.g., 3:1 to 12:1, or 5:1 to 10:1); a catalyst contact time of 1 to 10 seconds (e.g., 2 to 5 seconds).

The term "hydrocarbon partial pressure" is used herein to indicate the overall hydrocarbon partial pressure in the riser reactor. The term "catalyst-to-oil ratio' refers to the ratio of the catalyst circulation amount (e.g., ton/h) and the feedstock supply rate (e.g., ton/h). The term "catalyst contact time" is used herein to indicate the time from the point of contact between the feedstock and the catalyst at the catalyst inlet of the riser reactor until separation of the reaction products and the catalyst at the stripper outlet.

Steam may be concurrently introduced with the feed into the reaction zone. The steam may comprise up to about 5 wt. % of the feed.

Coke formation in an FCC unit can be the most critical parameter to maintain heat balance. Coke produced in the riser is burnt in the presence of air in the regenerator. Burning the coke is an exothermic process that can supply the heat demands of the reactor, i.e., heat of vaporization, and associated sensible heat of the feedstock, endothermic heat of cracking, etc. In a heat balanced operation typical of most FCC operations, the quantity of coke formed on the catalyst is significant enough that no external heat source or fuel is needed to supplement the heat from coke combustion. The amount of coke formation is one particular aspect of the present disclosure since the catalytic cracking unit is processing almost entirely, if not entirely or exclusively, a renewable feedstock. It is the processing of this feedstock, without the introduction of other sources of hydrocarbon feeds and without the introduction of other heat sources into the regenerator such as torch oils or other hydrocarbon fuels, besides the coke that is contained on the spent catalyst even more important than it ordinarily is with conventional catalytic cracking operations. It is the combination of catalyst selection, operating conditions and potentially other features that enable the operation of the catalytic cracking unit, with its processing of essentially exclusively a renewable feedstock, in heat balance mode without the addition of an external source of heat. In some aspects, the coke yield in the present process can be at least 4 wt. % (e.g., at least 5 wt. %, 4 to 8 wt. %, 4 to 7 wt. %, 5 to 8 wt. %, 5 to 7 wt. %, or 4.5 to 5.5. wt. %).

Catalyst

The FCC catalyst is circulated through the unit in a continuous manner between catalytic cracking reaction and regeneration while maintaining the equilibrium catalyst in the reactor. In conventional processes, a catalyst injection system maintains a continuous or semi-continuous addition of fresh catalyst to the inventory circulating between the regenerator and the reactor. In the present process, discarded or spent catalyst from a high activity FCC process is employed in the place of fresh catalyst. Spent catalyst is usually considered industrial waste and some refineries pay to dispose of this material. Advantageously, such waste spent catalyst can be re-used herein for upgrading renewable feedstocks.

The spent catalyst may be added directly to the regeneration zone of the FCC unit or at any other suitable point.

Catalysts that can be employed herein are cracking catalysts comprising either a large-pore zeolite or a mixture of at least one large-pore zeolite catalyst and at least one medium-pore molecular sieve catalyst. Examples of large-pore zeolites include a Y zeolite with or without rare earth metal, a HY zeolite with or without a rare earth metal, an ultra-stable Y zeolite with or without a rare earth metal, a Beta zeolite with or without a rare earth metal, and combination thereof. Examples of medium-pore zeolites include ZSM-5, ZSM-11, ZSM-12, ZSM-23, ZSM-35, ZSM-48, and other similar materials.

The cracking catalyst can comprise, on a dry basis, 10 to 50 wt. % by weight of a zeolite, 5 to 90 wt. % by weight of an amorphous inorganic oxide and 0 to 70 wt. % by weight of a filler, based on the weight of the cracking catalyst. Examples of amorphous inorganic oxides include, silica, alumina, titania, zirconia, and magnesium oxide. Examples of fillers include clays such as kaolin and halloysite.

A blend of large-pore and medium-pore zeolites may be used. The weight ratio of the large-pore zeolite to the medium-pore size zeolite in the cracking catalyst can be in a range of 99:1 to 70:30 (e.g., 98:2 to 85:15).

The spent catalyst may be a metal poisoned spent catalyst. The metal can be an alkali metal, an alkaline earth metal, a transition metal, or a combination thereof. The alkali metal can be sodium (Na), potassium (K), or a combination thereof. The alkaline earth metal can be magnesium (Mg), calcium (Ca), or a combination thereof. The transition metal can be vanadium (V), nickel (Ni), iron (Fe), or a combination thereof. In some aspects, the metal poisoned spent catalyst comprises one or more metals selected from Na, K, Mg, Ca, V, Ni, and Fe. In other aspects, the metal poisoned spent catalyst comprises one or more metals selected from Na, K, Mg, Ca, and Fe. The metal poisoned spent catalyst can have a metal concentration of at least 500 ppm (e.g., 500 to 35000 ppm, 500 to 20000 ppm, 750 to 20000 ppm, or 500 to 3000 ppm).

Products

The product stream comprising cracked hydrocarbon products may be separated into two or more constituent streams by conventional means. Constituent streams may include a fuel gas stream, an ethylene stream, a propylene stream, a butylene stream, an LPG stream, a naphtha stream, an olefin stream, a diesel stream, a gasoline stream, a light cycle oil stream, an aviation fuel stream, a cat unit bottoms (slurry/decant oil) stream, and other hydrocarbon streams.

In some aspects, a constituent stream may be further processed. For example, an olefinic constituent stream may be sent to an alkylation unit for further processing. In addition, olefins from the constituent streams may be further separated and recovered for use in renewable plastics and petrochemicals.

Renewable hydrocarbon fuel products may be sold or further processed. Examples of further processing include blending, hydroprocessing, or alkylating at least a portion of the renewable hydrocarbon fuel product. Renewable hydrocarbon fuel products may be used as a blend stock and combined with one or more petroleum fuel products and/or renewable fuels. Petroleum-based streams include gasoline, diesel, aviation fuel, or other hydrocarbon streams obtained by refining of petroleum. Examples of renewable fuels include ethanol, propanol, and butanol.

In some aspects, the product stream can comprise a gasoline fraction in an amount ranging from 30 to 60 wt. % (e.g., 40 to 50 wt. %), based on the total product stream composition, as measured by ASTM D2887.

EXAMPLES

The following illustrative examples are intended to be non-limiting.

A series of laboratory tests were carried out to study cracking of lipids under FCC conditions. The lipid used was soybean oil (SBO). Regenerated equilibrium catalyst (Ecat) was obtained from an FCC unit. Metal doped Ecat was prepared by impregnating the Ecat with about 10,000 ppm metals (Na, K, Mg, Ca, Fe) followed by steam deactivation at 1472° F. (800° C.) to provide a severely deactivated Ecat material.

Figure 2:
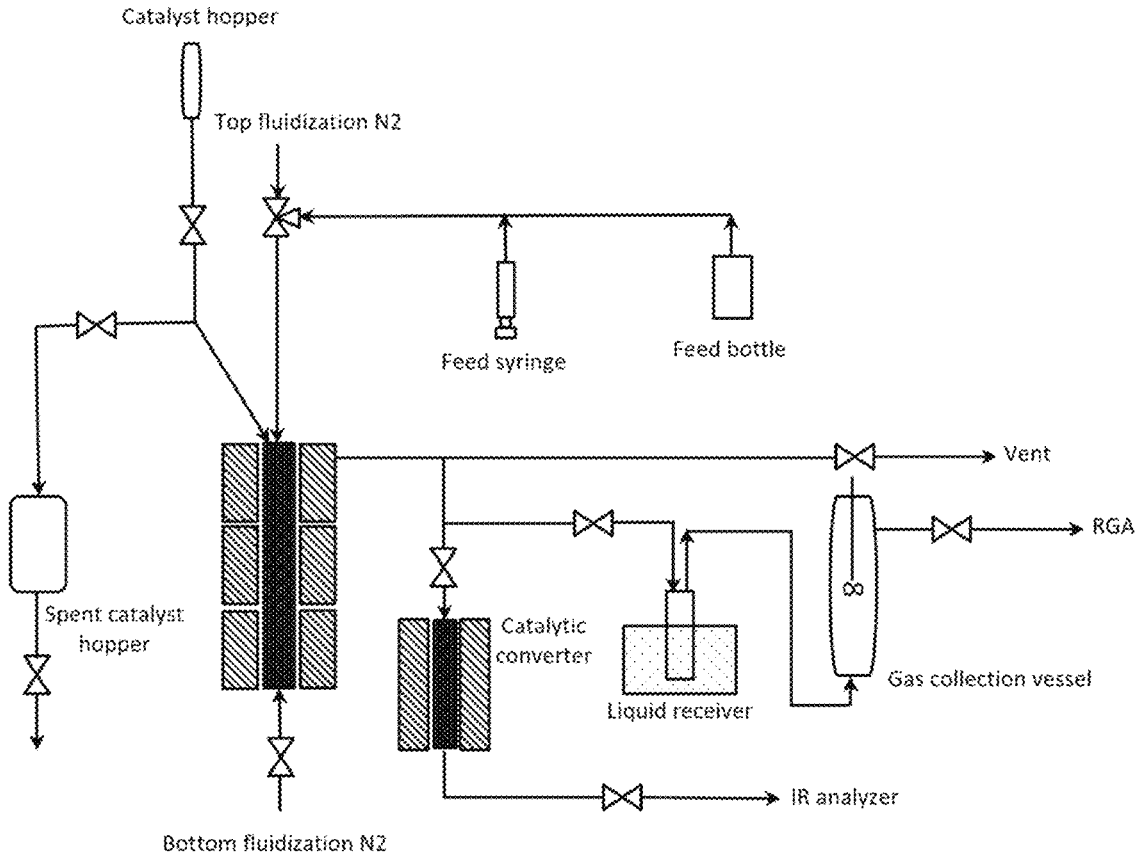
FIG. 2 is a schematic diagram for an experimental setup in the example section, according to an illustrative embodiment.

Catalytic cracking experiments were carried out in an Advanced Cracking Evaluation (ACE) Model C unit fabricated by Kayser Technology Inc. (Texas, USA). A schematic diagram of the ACE Model C unit is shown in FIG. 2. The reactor employed in the ACE unit was a fixed fluidized reactor with 1.6 cm ID. Nitrogen was used as fluidization gas and introduced from both bottom and top. The top fluidization gas was used to carry the feed injected from a calibrated syringe feed pump via a three-way valve. The catalytic cracking of soybean oil was carried out at atmospheric pressure and temperatures from 850° F. to 1050° F. For each experiment, a constant amount of feed was injected at the rate of 1.2 g/min for 75 seconds. The catalyst/oil ratio, between 5 to 8, was varied by varying the amount of catalyst. After 75 seconds of feed injection, the catalyst was stripped off by nitrogen for a period of 525 seconds.

During the catalytic cracking and stripping process the liquid product was collected in a sample vial attached to a glass receiver, which was located at the end of the reactor exit and was maintained at −15° C. The gaseous products were collected in a closed stainless-steel vessel (12.6 L) prefilled with $N_2$ at 1 atm. Gaseous products were mixed by an electrical agitator rotating at 60 rpm as soon as feed injection was completed. After stripping, the gas products were further mixed for 10 mins to ensure homogeneity. The final gas products were analyzed using a refinery gas analyzer (RGA).

After the completion of stripping process, in-situ catalyst regeneration was carried out in the presence of air at 1300° F. The regeneration flue gas passed through a catalytic converter packed with CuO pellets (LECO Inc.) to oxidize CO to $CO_2$. The flue gas was then analyzed by an online infrared (IR) analyzer located downstream the catalytic converter. Coke deposited during cracking process was calculated from the $CO_2$ concentrations measured by the IR analyzer.

Example 1

Figure 3:
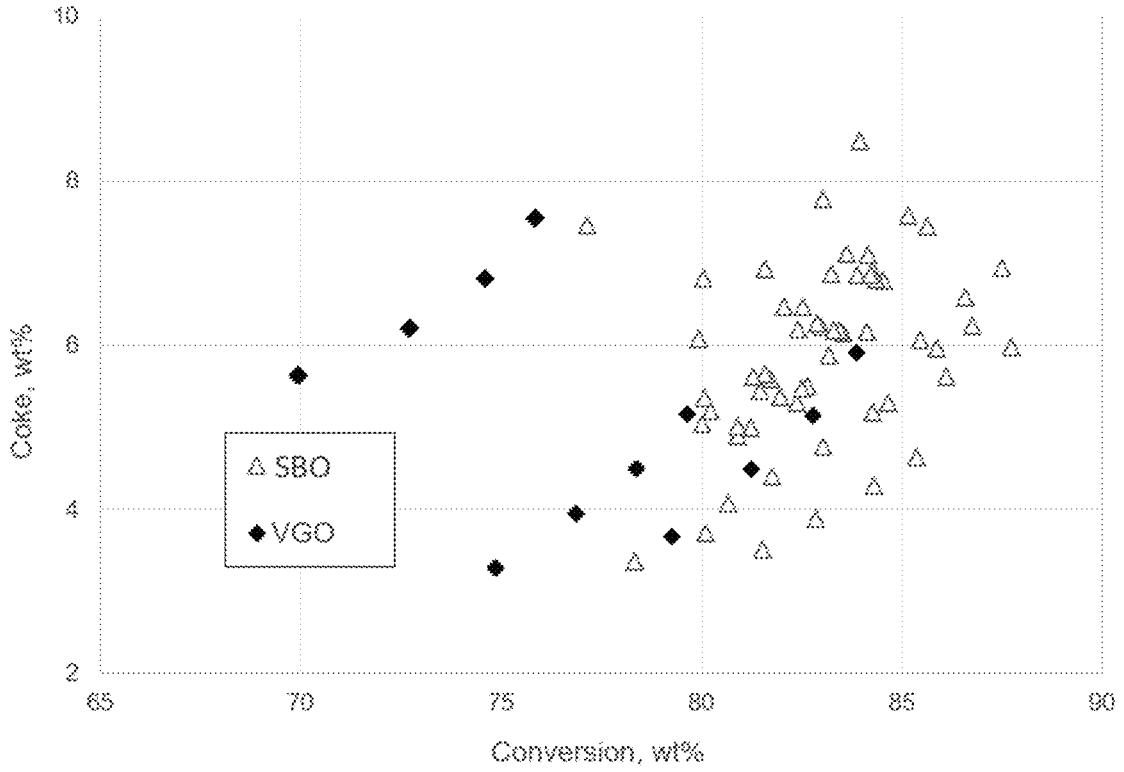
FIG. 3 is a graph illustrating the relationship between coke yield and conversion of vacuum gas oil (VGO) and soybean oil (SBO) feedstocks, according to an illustrative embodiment.

FIG. 3 is a graph illustrating the relationship between coke yield and conversion in the catalytic cracking of vacuum gas oil (VGO) and soybean oil (SBO) feedstocks in the ACE unit. Coke yields for cracking VGO on FCC Ecat ranges from about 3% to about 8%. At similar conditions, cracking SBO and VGO on FCC Ecat results in comparable coke yield. The results indicate that heat balance can be satisfied when running a 100% lipid feedstock in an FCC unit.

Example 2

Figure 4A:
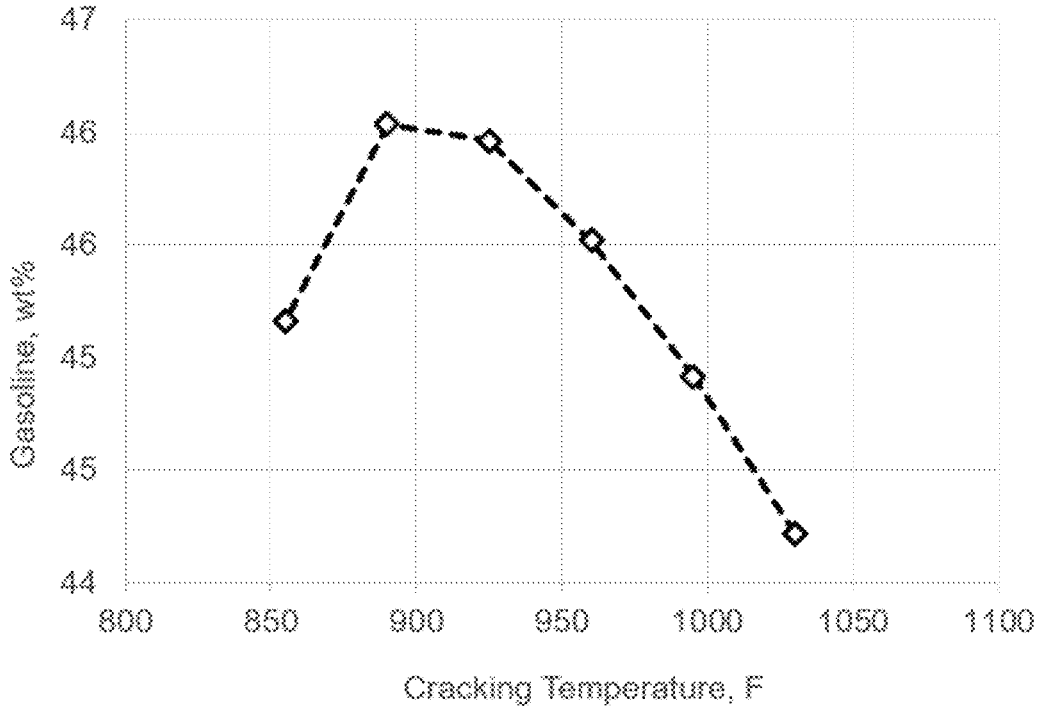
FIG. 4(A) is a graph illustrating the relationship between yield of gasoline boiling range hydrocarbons and cracking temperature for a 100% SBO feedstock, according to an illustrative embodiment.
Figure 4B:
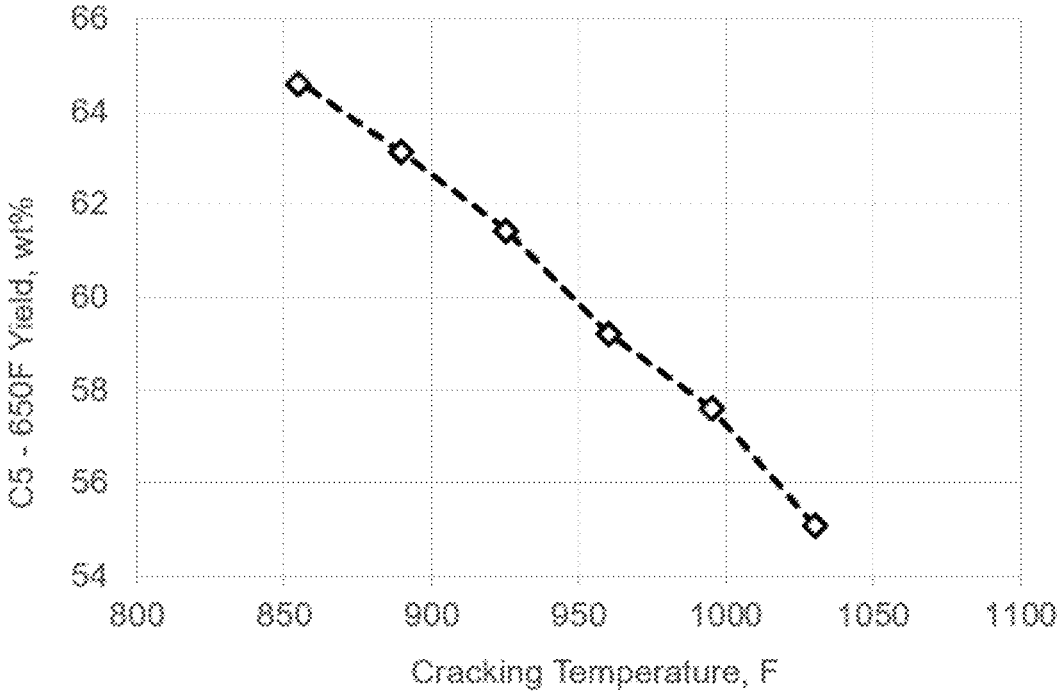
FIG. 4(B) is a graph illustrating the relationship between yield of C5 to 650° F. boiling range hydrocarbons and cracking temperature for a 100% SBO feedstock, according to an illustrative embodiment.

FIG. 4(A) is a graph illustrating the relationship between yield of gasoline boiling range hydrocarbons and cracking temperature in the catalytic cracking of a 100% SBO feedstock in the ACE unit. FIG. 4(B) is a graph illustrating the relationship between yield of C5 to 650° F. boiling range hydrocarbons and cracking temperature for a 100% SBO feedstock in the ACE unit. Gasoline is one of the most valuable product streams from an FCC unit. As shown in FIG. 4(A), maximum gasoline yield occurs at about 900° F. As shown in FIG. 4(B), lower temperatures favor higher yields of C5 to 650° F. hydrocarbon products (e.g., gasoline and light cycle oil). In general, cracking of conventional VGO feeds in an FCC unit occurs at about 950° F. to about 1000° F., which is generally too severe for cracking of lipid feedstocks. The results indicate that a dedicated FCC unit cracking exclusively renewable feedstocks can operate at a lower temperature to optimize yields of valuable hydrocarbon products without competing with VGO cracking.

Example 3

Figure 5:
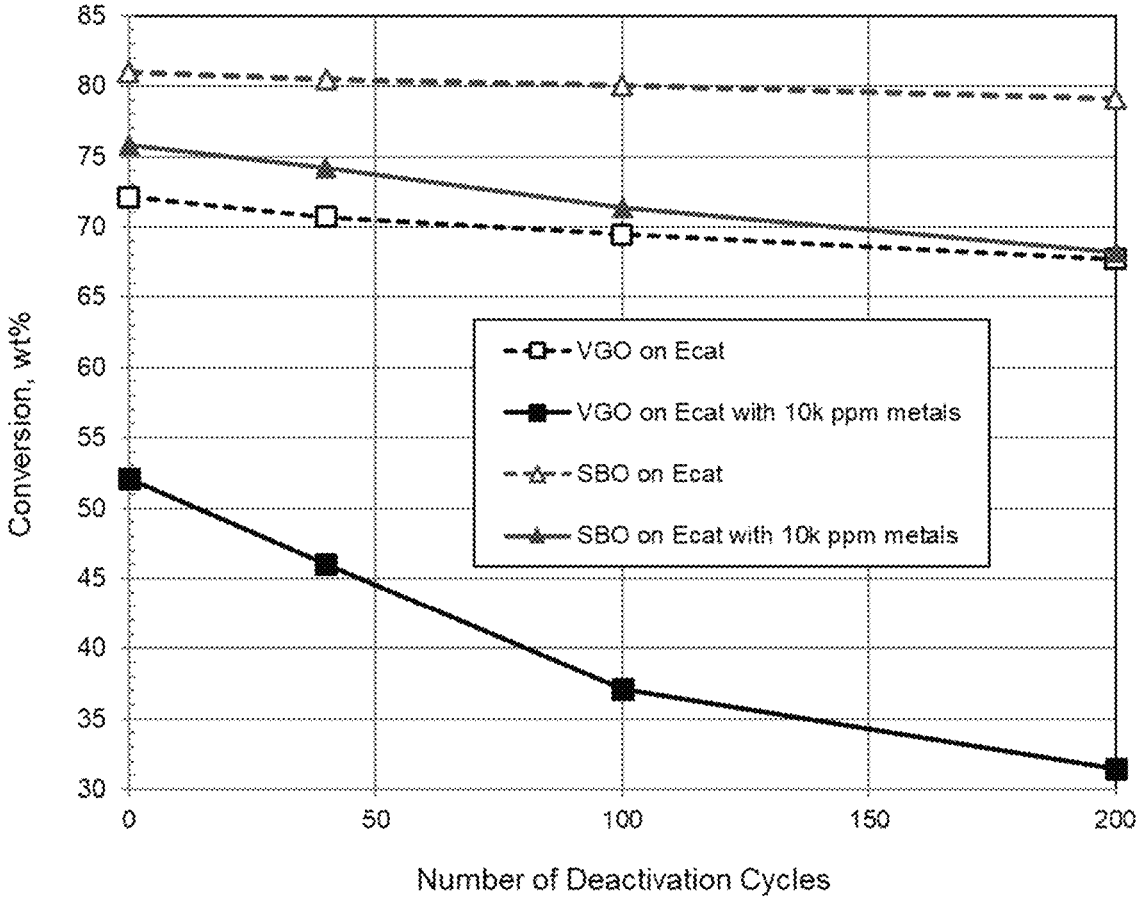
FIG. 5 is a graph illustrating the relationship between conversion and number of steaming deactivation cycles in the catalytic cracking of VGO and SBO feedstocks with conventional equilibrium catalyst (Ecat) and metal doped Ecat, according to an illustrative embodiment.

FIG. 5 is a graph illustrating the relationship between conversion and number of steaming deactivation cycles in the catalytic cracking of VGO and SBO feedstocks with conventional Ecat and severely deactivated Ecat in the ACE unit. Steam and metals deactivate FCC catalysts. As shown in FIG. 5, greater loss of catalytic activity is observed with a VGO feedstock than with a lipid feedstock. The results indicate that cracking of lipids does not require high activity catalysts such as for VGO feedstocks. Additionally, the results show that adding Ecat alone can be effective for cracking 100% lipid feedstocks in an FCC unit without the addition of fresh cracking catalyst.

Example 4

Figure 6:
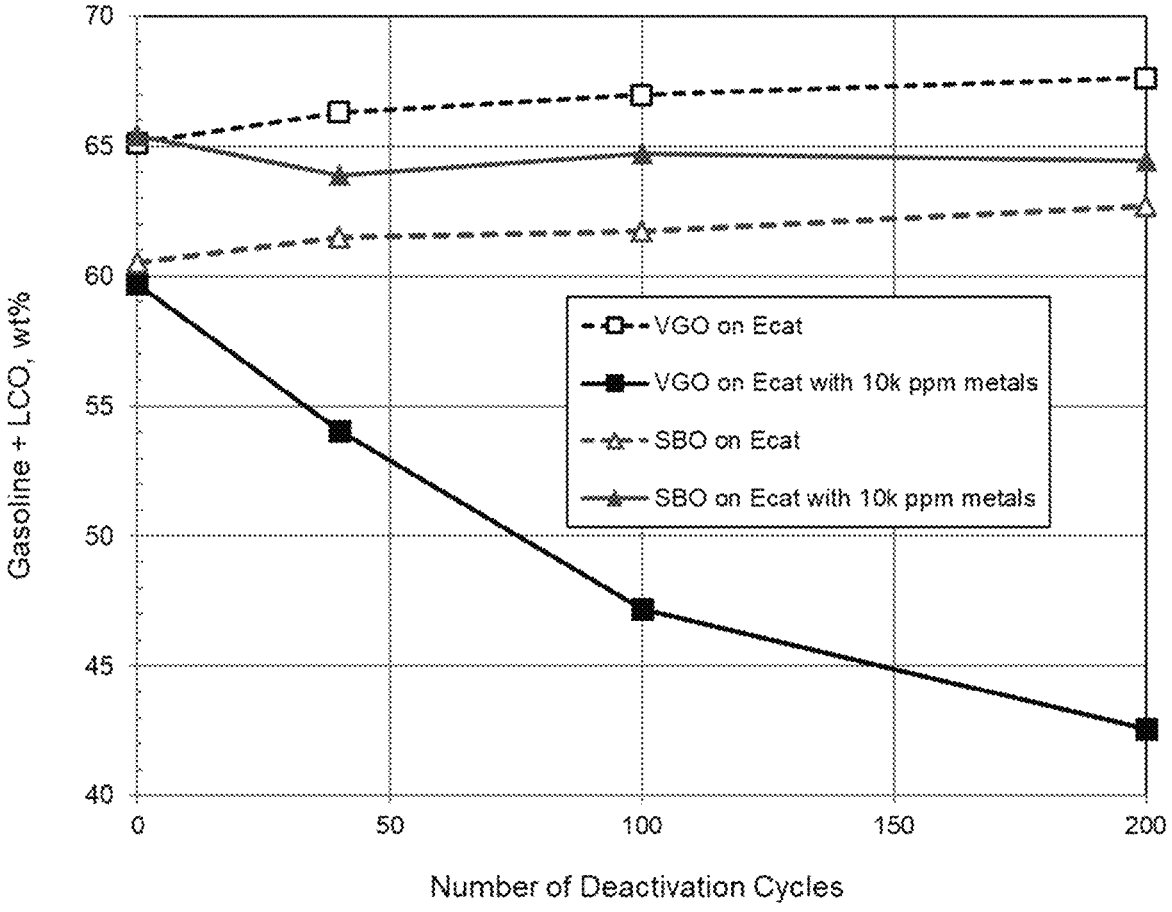
FIG. 6 is a graph illustrating the relationship between yield of gasoline and light cycle oil (LCO) boiling range hydrocarbons and number of steaming deactivation cycles in the catalytic cracking of VGO and SBO feedstocks with conventional Ecat and metal doped Ecat, according to an illustrative embodiment.

FIG. 6 is a graph illustrating the relationship between yield of gasoline and LCO boiling range hydrocarbons in the catalytic cracking of VGO and SBO feedstocks with conventional Ecat and metal doped Ecat in the ACE unit. Unexpectedly, catalytic cracking of SBO feedstock with severely deactivated Ecat resulted in increased yield of gasoline and LCO boiling range hydrocarbons with increasing deactivation cycles, whereas catalytic cracking of the VGO feedstock resulted in significantly reduced yield of gasoline and LCO boiling range hydrocarbons with increasing deactivation cycles.

The invention claimed is:

1. A process for upgrading a renewable feedstock, the process comprising:

(a) introducing the renewable feedstock into a fluid catalytic cracking (FCC) reactor unit operating under catalytic cracking conditions and comprising a circulating inventory of an equilibrium catalyst composition;

(b) removing a portion of the equilibrium catalyst inventory from the FCC reactor unit while replacing all the equilibrium catalyst removed from the unit with a spent catalyst to obtain a composite circulating catalyst within the FCC reactor unit; and (c) contacting the composite circulating catalyst with the renewable feedstock in the FCC reactor unit under a steady state environment to provide a product stream comprising cracked products.

2. The process of claim 1, wherein the renewable feedstock is a material selected from triglycerides, diglycerides, monoglycerides, fatty acids, and combinations thereof.

3. The process of claim 1, wherein the renewable feedstock is selected from vegetable oils, animal fats, algae oils, and combinations thereof.

4. The process of claim 1, wherein the renewable feedstock further comprises a material absence of a hydrocarbon source other than the renewable feedstock.

5. The process of claim 1, wherein the spent catalyst is a metal poisoned spent catalyst.

6. The process of claim 5, wherein the metal poisoned spent catalyst comprises a metal selected from an alkali metal, an alkaline earth metal, a transition metal, or a combination thereof.

7. The method of claim of claim 5, wherein the metal poisoned spent catalyst comprises a metal selected from sodium, potassium, magnesium, calcium, vanadium, nickel, iron, or a combination thereof.

8. The process of claim 5, wherein the metal poisoned spent catalyst has a metal concentration of at least 500 ppm.

9. The process of claim 1, wherein the cracking conditions include: a reaction temperature of 797° F. to 977° F. (425° C. to 525° C.); a hydrocarbon partial pressure of 100 to 400 kPa; a catalyst-to-oil ratio of 2:1 to 20:1; and a catalyst contact time of 1 to 10 seconds.

10. The process of claim 1, wherein coke yield is in a range of 4 to 8 wt. %.

11. The process of claim 1, further comprising subjecting the renewable feedstock to a purification treatment prior to (a).

12. The process of claim 11, wherein the purification treatment comprises at least one purification step selected from the group consisting of filtration, degumming, bleaching, solvent extraction, hydrolysis, ion-exchange resin treatment, mild acid wash, evaporative treatment, and any combination thereof.

13. The process of claim 1, further comprising separating the product stream into two or more constituent streams.

14. The process of claim 13, wherein the two or more constituent streams comprise at least two of a fuel gas stream, an ethylene stream, a propylene stream, a butylene stream, an LPG stream, a naphtha stream, an olefin stream, a diesel stream, a gasoline stream, a light cycle oil stream, a jet fuel stream, and a cat unit bottoms (slurry/decant oil) stream.

15. The process of claim 14, wherein at least one constituent stream is a gasoline stream, and further comprising blending the gasoline stream with a petroleum gasoline product and/or with one or more renewable fuels.

16. The process of claim 14, wherein the wherein at least one constituent stream is an olefin stream, and further comprising feeding the olefin stream to an alkylation unit.

* * * * *